US006860446B2

(12) United States Patent
Fair et al.

(10) Patent No.: US 6,860,446 B2
(45) Date of Patent: Mar. 1, 2005

(54) METHOD AND APPARATUS FOR WINDING A COIL

(75) Inventors: Roderick D. Fair, Richmond, IN (US); Stuart W. Perry, Anderson, IN (US)

(73) Assignee: Delphi Technologies, Inc., Troy, MI (US)

( * ) Notice: Subject to any disclaimer, the term of this patent is extended or adjusted under 35 U.S.C. 154(b) by 119 days.

(21) Appl. No.: 10/295,560

(22) Filed: Nov. 14, 2002

(65) Prior Publication Data

US 2004/0094653 A1 May 20, 2004

(51) Int. Cl.[7] ..... B65H 54/28

(52) U.S. Cl. ..... 242/479.6; 242/479.8; 242/479.7

(58) Field of Search ..... 242/479.8, 479.6, 242/479.7

(56) References Cited

U.S. PATENT DOCUMENTS

| | | | | |
|---|---|---|---|---|
| 2,267,899 A | * | 12/1941 | Dersen | 242/479.7 |
| 3,074,659 A | * | 1/1963 | Furst | 242/479.8 |
| 5,929,736 A | | 7/1999 | Sakamaki et al. | |
| 6,087,918 A | | 7/2000 | Henry et al. | |
| 6,156,264 A | | 12/2000 | Johnston et al. | |
| 6,188,304 B1 | | 2/2001 | Skinner et al. | |
| 6,215,385 B1 | | 4/2001 | Ogden | |
| 6,216,679 B1 | | 4/2001 | Skinner et al. | |
| 6,232,863 B1 | | 5/2001 | Skinner et al. | |
| 6,276,348 B1 | | 8/2001 | Skinner et al. | |
| 6,422,225 B1 | | 7/2002 | Hamer et al. | |
| 6,426,032 B1 | | 7/2002 | Osuka et al. | |
| 6,437,674 B1 | | 8/2002 | Hamer et al. | |
| 6,556,116 B2 | | 4/2003 | Skinner et al. | |
| 6,556,118 B1 | | 4/2003 | Skinner | |
| 6,615,811 B1 | | 9/2003 | Butler et al. | |
| 6,622,711 B1 | | 9/2003 | Skinner et al. | |
| 6,634,590 B1 | * | 10/2003 | Rau et al. | 242/479 |

* cited by examiner

*Primary Examiner*—Kathy Matecki
*Assistant Examiner*—Evan Langdon
(74) *Attorney, Agent, or Firm*—Jimmy L. Funke

(57) ABSTRACT

Method and winding apparatus for winding a coil that may be used in a high voltage coil assembly. The method allows providing a bobbin. The bobbin may include at one end thereof a start wedge having a wedge angle relative to the longitudinal axis of the bobbin. Relative alignment is provided between the bobbin and a wire feeder device so that a strand of wire from the wire-feeder device is fed perpendicular relative to a layer of winding that, upon rotation of the bobbin, progressively propagates along the longitudinal axis of the bobbin with a predefined winding angle.

22 Claims, 4 Drawing Sheets

METHOD AND APPARATUS FOR WINDING A COIL

BACKGROUND OF THE INVENTION

This invention relates to coils, such as ignition coils for spark ignition engines or any other high-voltage coil application, and, more particularly, to techniques for delivering the wire relative to a workpiece being wound to reduce wire slippage of a winding that may be wound using techniques generally referred in the art as bank, progressive, or pilgrim winding techniques.

It is known in the art of ignition systems for automotive applications to have an ignition coil that produces electromagnetic energy to create upon discharge a high voltage spark for initiating combustion in an engine cylinder. Typically, the ignition coil includes primary and secondary windings each wound around a bobbin or spool and disposed about a magnetic core. The foregoing description refers to ignition coils for automotive applications. However, the issues are also applicable to any high voltage coil for non-automotive, non-ignition applications.

The windings may be progressively wound around a receiving bobbin. As shown in FIG. 1, the winding equipment, e.g., a spindle drive 10 that may be mechanically coupled to a motor 11, presently requires the workpiece (e.g., the bobbin 12) to be wound to be held horizontally, with an incoming strand of wire 14, e.g., supplied by a wire feeder device 16, perpendicular relative to the horizontally positioned workpiece. With this winding technique, the strand of wire is wound to form a winding layer at an angle to reduce the number of turns between adjacent wires and thus keep the voltage potential low between two adjacent wires. One problem that may develop with this type of winding technique is wire slippage that may occur between wire layers wound around the coil bobbin, which could create an undesirable large voltage potential between adjacent wires, possibly resulting in arcing and/or electrical shorts. When wires are wound at an angle, the wires at the surface of the bobbin can slip and slide axially along the bobbin due to the tension and forces that may act on these wires.

FIG. 2 is an exemplary free body diagram corresponding to the winding technique of FIG. 1 illustrating the principal acting forces, which include force components along an orthogonal set of axes, e.g., X-Y axes. If there are residual force components not properly balanced along both the X and Y-axes, then wire slippage can occur. In the event slippage occurs, a new strand of wire will be wound on top of the slipped wire as the winding operation continues, resulting in a relatively high wire-to-wire voltage when the coil is operated. Thus, there is a need to provide improved winding techniques that would allow decreasing or avoiding wire slippage. This would allow suppliers, such as the assignee of the present invention, to maintain high quality and cost-effective progressive winding operations.

BRIEF SUMMARY OF THE INVENTION

Generally, the present invention fulfills the foregoing needs by providing in one aspect thereof, a method for winding a coil. The method allows providing a bobbin. The bobbin may include at one end thereof a start wedge having a wedge angle relative to the longitudinal axis of the bobbin. A wire-feeder device is provided and relative alignment is provided between the bobbin and the wire feeder device so that a strand of wire from the wire-feeder device is fed perpendicular relative to a layer of winding that, upon rotation of the bobbin, progressively propagates along the longitudinal axis of the bobbin with a predefined winding angle.

In another aspect thereof, the present invention further fulfills the foregoing needs by providing an apparatus for winding a coil. The winding apparatus includes a bobbin that may include at one end thereof a start wedge having a wedge angle relative to the longitudinal axis of the bobbin. The winding apparatus further includes a wire-feeder device, and a spindle drive mechanically connected to the bobbin to impart rotation to the bobbin during a winding operation. The spindle drive is positioned to provide relative alignment between the bobbin and the wire feeder device so that a strand of wire supplied by the feeder device is fed perpendicular relative to a layer of winding that progressively propagates along the longitudinal axis of the bobbin with a predefined winding angle.

BRIEF DESCRIPTION OF THE DRAWINGS

The features and advantages of the present invention will become apparent from the following detailed description of the invention when read with the accompanying drawings in which:

FIG. 4 illustrates a partially wound bobbin, and FIG. 5 illustrates a fully wound bobbin including a main body of winding and an optional end winding section.

DETAILED DESCRIPTION OF THE INVENTION

Figure 3A:
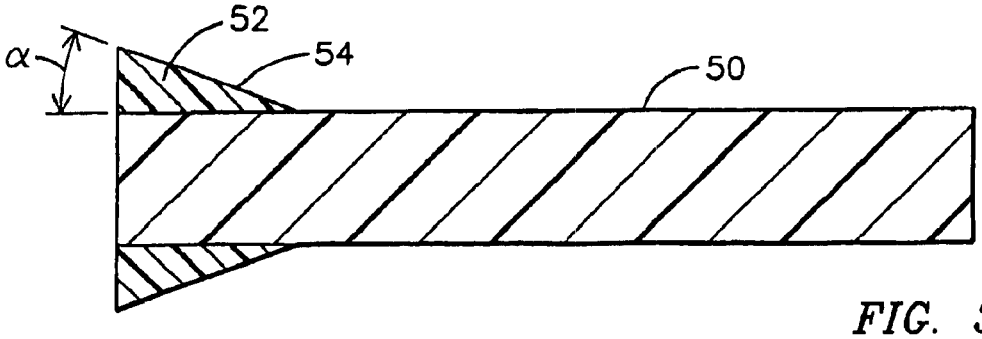
FIGS. 3–5 are used to visually facilitate understanding the concept of progressive winding. More particularly, FIG. 3, made up of FIGS. 3A–3C, illustrates an exemplary bobbin including a start wedge having a surface with a wedge angle for progressively receiving a strand of wire to eventually form a coil.
Figure 3B:
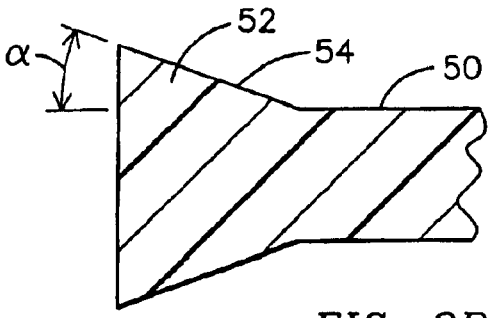
Figure 3C:
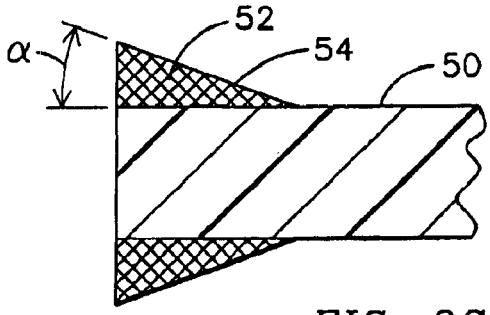

FIG. 3 illustrates an exemplary bobbin 50 including a start wedge 52, e.g., a frusto-conical structure, having a surface with a wedge angle a for progressively receiving a strand of wire to eventually form a winding, such as may be used in ignition coils for automotive applications or any other relatively high-voltage applications. It will be understood that the start wedge may be constructed in various ways. For example, as illustrated in FIG. 3C, the start wedge may be part of the winding since the start wedge may be formed by building up or stacking a plurality of layers of winding on the generally cylindrical surface of the bobbin. Thus, the start wedge could (but need not) be either a separate structure mounted on the bobbin as shown in FIG. 3A, or a structure integrally constructed (e.g., by molding) with the bobbin, as shown in FIG. 3B.

Figure 1:
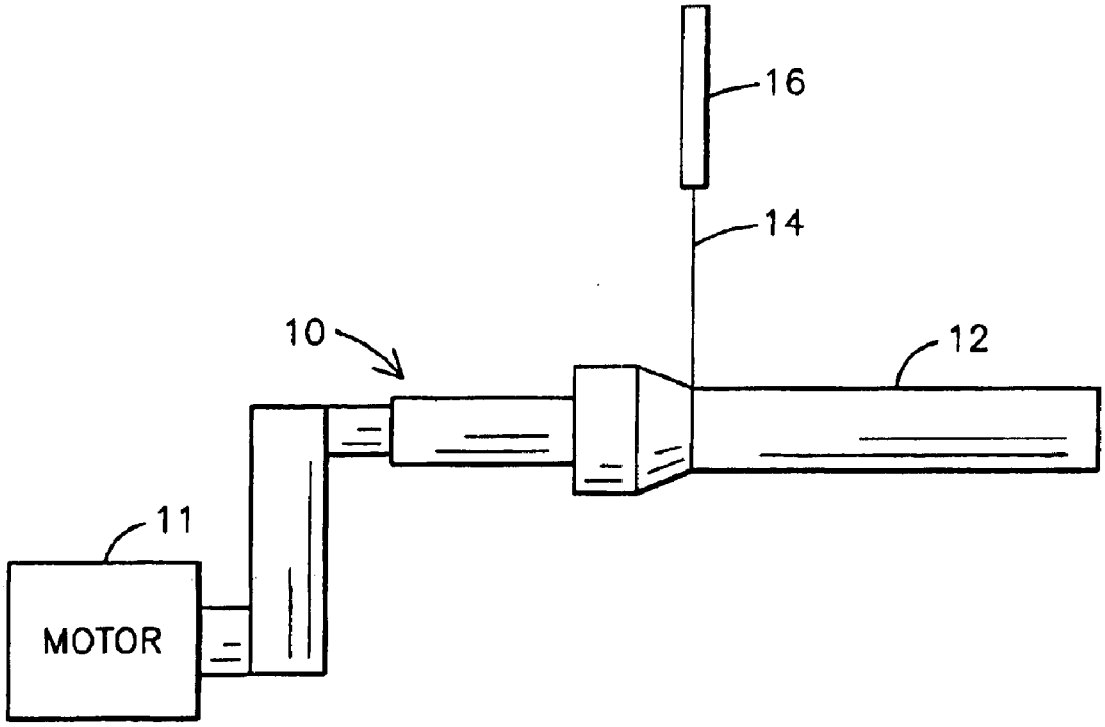
FIG. 1 PRIOR ART
FIG. 1 illustrates an arrangement of winding equipment for performing a known winding technique.
Figure 4:
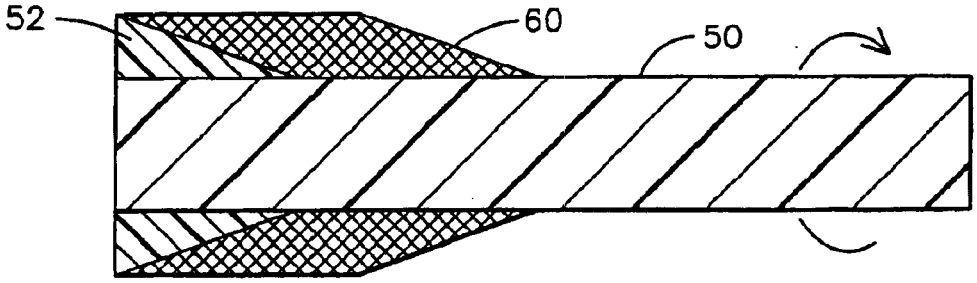
Figure 5:
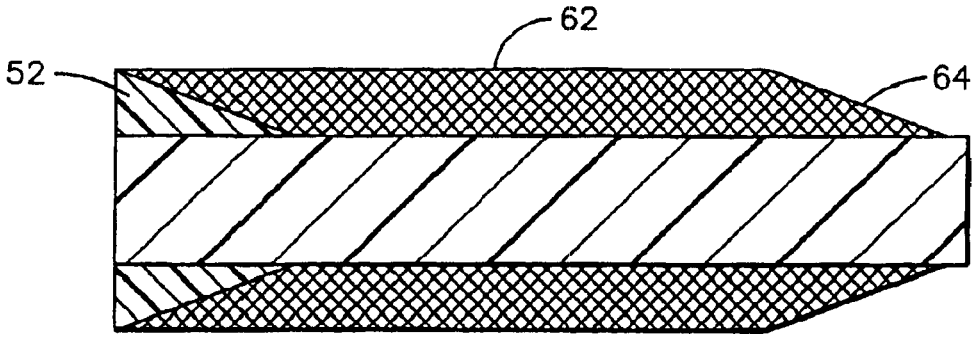

FIG. 4 illustrates a partially wound bobbin 50. As will be appreciated by those skilled in the art, the winding progression results in axial propagation of a layer of winding 60 with a predefined winding angle. The winding angle defines the relative orientation of the winding layer being wound upon relative to the original surface of the bobbin. In general, the agale $\alpha$ provided by the "start wedge", may or may not correspond to the winding angle that one actually uses to propagate the winding along the bobbin, particularly, if the "start wedge" is structure other than wire. The predefined winding angle may vary based on various design considerations, such as the gauge of the strand of wire being wound, the tension on the wire, etc. Traditionally, the winding angle used in the techniques represented in FIG. 1 has ranged approximately from 10 to 12 degrees. It is believed that techniques embodying aspects of the present invention would allow advantageously increasing the range of the winding angle possibly up to approximately 30 degrees or more. FIG. 5 illustrates a fully wound bobbin 50 including a main body of winding 62 and an optional end winding section 64. Although FIG. 5 shows end section 64 configured to taper, it will be appreciated that in general a fully wound bobbin may or may not have an end winding section that tapers.

The inventors of the present invention have innovatively recognized that substantial reduction of wire slippage may be achieved by feeding a wire strand substantially perpendicular relative to the winding layer that propagates at the predefined winding angle relative to the longitudinal axis of the bobbin 50, in lieu of supplying the strand perpendicular relative to the horizontal surface of the bobbin.

Figure 2:
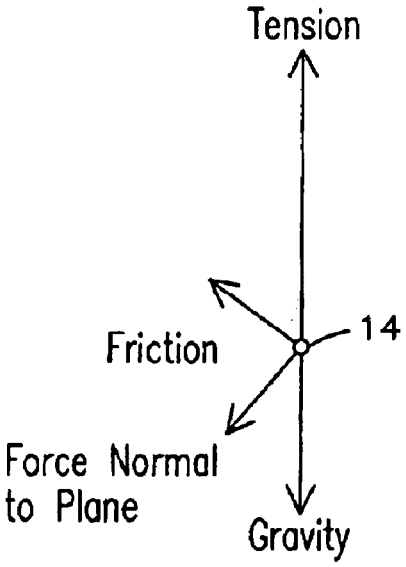
FIG. 2 PRIOR ART
FIG. 2 is an exemplary free body diagram corresponding to the winding technique of FIG. 1 illustrating the principal forces that may act on wire being wound to form a coil.
Figure 6:
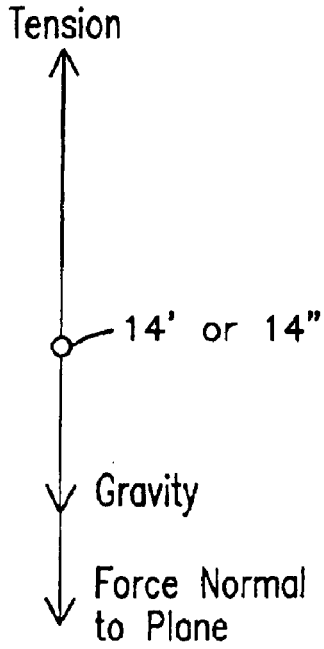
FIG. 6 illustrates a free body diagram for a winding technique embodying aspects of the present invention.

FIG. 6 illustrates a free body diagram for a winding technique embodying aspects of the present invention. It will be appreciated, by comparison of the free body diagram of FIG. 6 relative to the free body diagram of FIG. 2, that a winding technique embodying aspects of the present invention would result in force components essentially along just one axis, (e.g., along a vertical axis) as opposed to force components along a pair of mutually orthogonal axes. Thus, the underlying physics provided by winding equipment embodying aspects of the present invention is conducive to a more controllable and reliable winding operation since in this case wire slippage would be based on forces acting essentially along one axis, as opposed to a pair of mutually orthogonal axes. As will be appreciated by those skilled in the art, the free body diagrams, for simplicity of illustration and description, show the forces acting along a two-dimensional coordinate system, in actuality there would be forces acting in all three dimensions.

Figure 7:
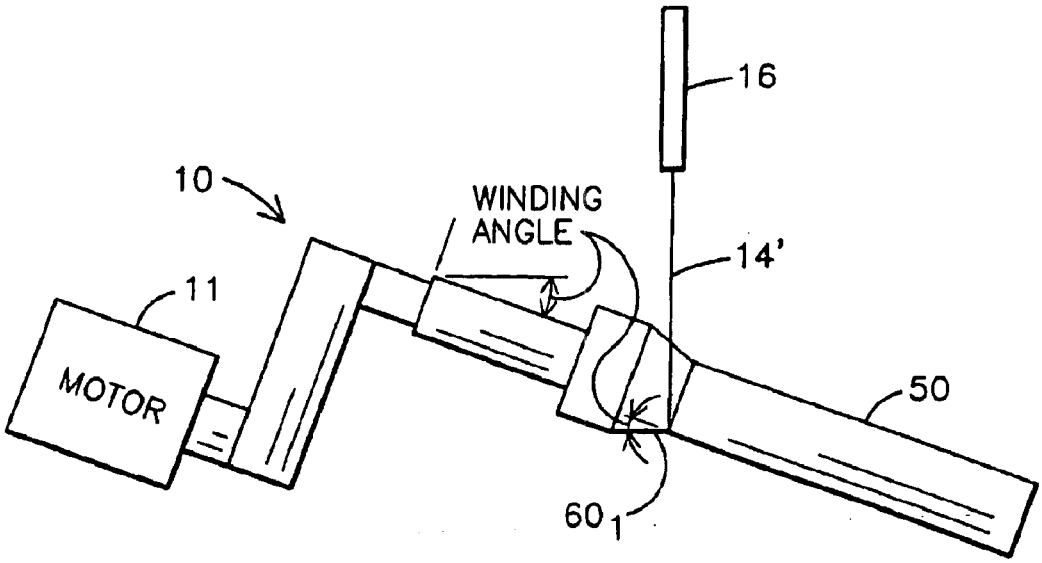
FIGS. 7 and 8 show schematic representations of respective exemplary embodiments where the spindle drive and in turn the bobbin being wound is each angularly positioned relative to one another with a tilt corresponding to a winding angle configured so that the strand of wire is perpendicular relative to a winding layer.

FIG. 7 shows a schematic of one exemplary embodiment where the spindle drive 10 and in turn the bobbin being wound is each angularly positioned with the predefined winding angle so that the strand of wire is perpendicular relative to winding layer $\mathbf{60}_1$. For example, as seen in the two-dimensional representation of FIG. 7, winding layer $\mathbf{60}_1$ would provide a bottom edge for normally receiving the strand of wire. In this embodiment, the end section of the bobbin would be generally at a lower level relative to the start wedge of the bobbin.

Figure 8:
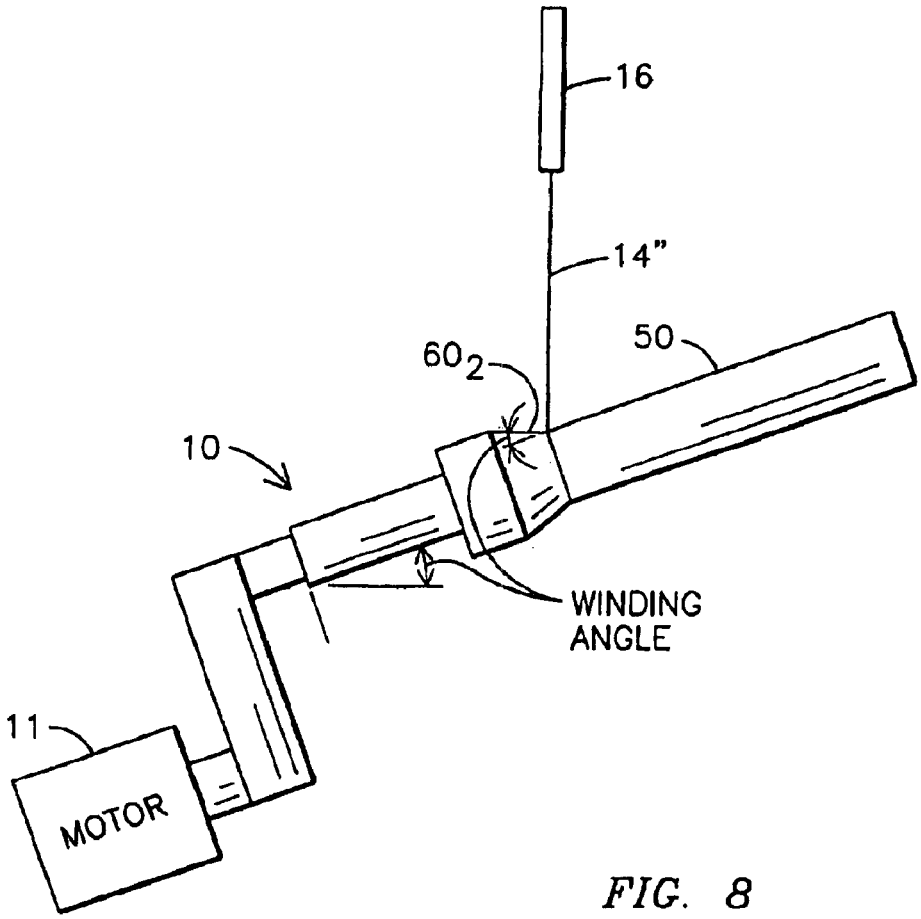
Figure 9:
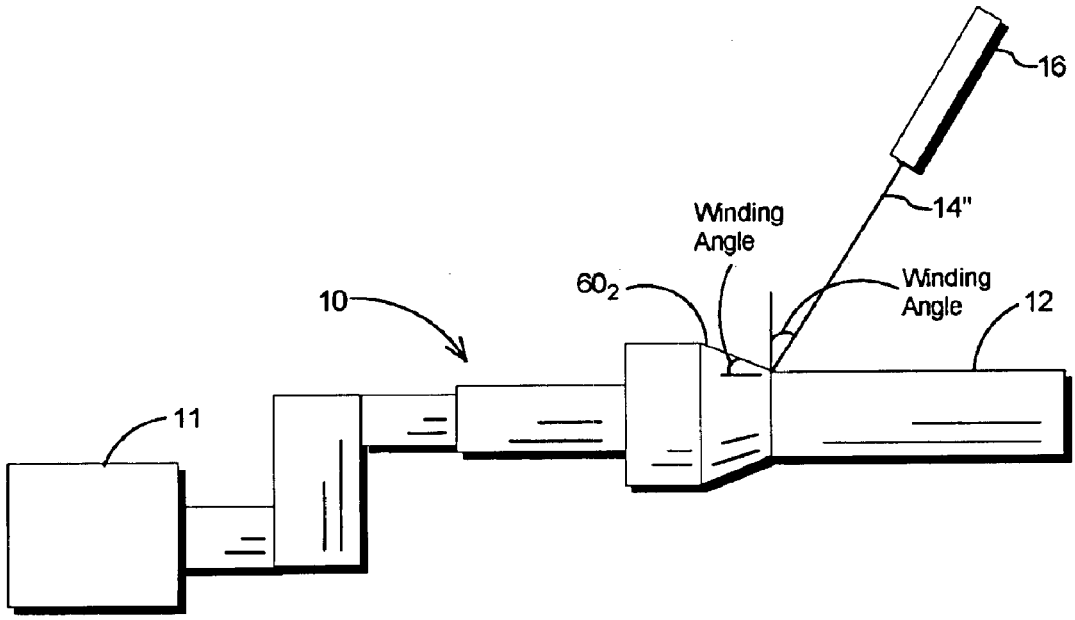
FIG. 9 shows a schematic representation of an exemplary embodiment where a wire feeder device is positioned with a tilt so that the strand of wire is perpendicular relative to a winding layer that is progressively wound with a winding angle.

FIG. 8 shows a schematic of another exemplary embodiment where the spindle drive 10 and in turn the bobbin being wound is each angularly positioned with the predefined winding angle so that once again the strand of wire is perpendicular relative to winding layer $\mathbf{60}_2$. For example, as seen in the two-dimensional representation of FIG. 8, winding layer $\mathbf{60}_2$ would provide a top edge for normally receiving the strand of wire. In this embodiment, the end section of the winding would be generally at a higher level relative to the start wedge in the bobbin. It will be appreciated that the present invention is not limited to the arrangements of FIGS. 7 and 8. For example as illustrated in FIG. 9, in alternative embodiments, the workpiece could be horizontally positioned and the wire feeder device 16 could be adjusted, e.g., tilted by an amount corresponding to the winding angle (either clockwise or counter-clockwise) to achieve the desired alignment between the strand of wire and the corresponding receiving winding surface. That is, to provide an alignment that allows the strand of wire to be fed perpendicular relative to the winding layer $\mathbf{60}_1$ or $\mathbf{60}_2$ that is progressively wound with the predefined winding angle.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. A method for winding a coil, the method comprising:

providing a bobbin;

providing at one end of the bobbin a start wedge having a wedge angle relative to the longitudinal axis of the bobbin;

providing a wire-feeder device; and providing relative alignment between the bobbin and the wire feeder device so that a strand of wire from the wire-feeder device is fed and continuously maintained perpendicular relative to a layer of winding that progressively propagates along the longitudinal axis of the bobbin with a predefined winding angle, the alignment thus provided enabling to reduce coil wire slippage.

2. The winding method of claim 1 wherein the providing of the start wedge comprises mounting a discrete structure on the bobbin, the discrete structure constituting the start wedge.

3. The winding apparatus of claim 1 wherein the providing of the start wedge comprises integrally constructing the start wedge and the bobbin.

4. The winding apparatus of claim 1 wherein the providing of the start wedge comprises stacking on the bobbin a plurality of winding layers onto one another, the stacked layers constituting the start wedge.

5. A method for winding a coil, the method comprising:

providing a bobbin;

providing at one end of the bobbin a start wedge having a wedge angle relative to the longitudinal axis of the bobbin;

providing a wire-feeder device; and providing relative alignment between the bobbin and the wire feeder device so that a strand of wire from the wire-feeder device is fed perpendicular relative to a layer of winding that progressively propagates along the longitudinal axis of the bobbin with a predefined winding angle, the alignment thus provided enabling to reduce coil wire slippage, wherein the providing of relative alignment between the bobbin and the wire feeder device comprises tilting the bobbin by an amount corresponding to the winding angle relative to a vertically incoming strand of wire.

6. The winding method of claim 5 wherein the tilting of the bobbin is performed clockwise relative to the vertically incoming strand of wire.

7. The winding method of claim 5 wherein the tilting of the bobbin is performed counter-clockwise relative to the vertically incoming strand of wire.

8. The winding method of claim 1 further comprising providing a spindle drive mechanically connected to the bobbin to impart rotation to the bobbin during a winding operation.

9. A method for winding a coil, the method comprising:

providing a bobbin;

providing at one end of the bobbin a start wedge having a wedge angle relative to the longitudinal axis of the bobbin;

providing a wire-feeder device;

providing a spindle drive mechanically connected to the bobbin to impart rotation to the bobbin during a winding operation; and providing a relative alignment between the bobbin and the wire feeder device so that a strand of wire from the wire-feeder device is fed perpendicular relative to a layer of winding that progressively propagates along the longitudinal axis of the bobbin with a predefined winding angle, the alignment thus provided enabling to reduce coil wire slippage, wherein the providing of relative alignment between the bobbin and the wire feeder device comprises tilting the spindle drive by an amount corresponding to the winding angle relative to a vertically incoming strand of wire.

10. The winding method of claim 1 wherein the providing of relative alignment between the bobbin and the wire feeder device comprises tilting the wire feeder device by an amount corresponding to the winding angle relative to a horizontally positioned bobbin.

11. The winding method of claim 10 wherein the tilting of the wire feeder device is performed clockwise relative to the horizontally positioned bobbin.

12. The winding method of claim 10 wherein the tilting of the wire feeder device is performed counter-clockwise relative to the horizontally positioned bobbin.

13. Winding apparatus comprising:

a bobbin including at one end thereof a start wedge having a wedge angle relative to the longitudinal axis of the bobbin;

a wire-feeder device; and a spindle drive mechanically connected to the bobbin to impart rotation to the bobbin during a winding operation, wherein the spindle drive is positioned to provide relative alignment between the bobbin and the wire feeder device so that a strand of wire supplied by the feeder device is fed and continuously maintained perpendicular relative to a layer of winding that progressively propagates along the longitudinal axis of the bobbin with a predefined winding angle, the alignment thus provided enabling to reduce coil wire slippage.

14. The winding apparatus of claim 13 wherein the start wedge comprises a discrete structure mounted on the bobbin.

15. The winding apparatus of claim 13 wherein the start wedge comprises a structure integrally constructed with the bobbin.

16. The winding apparatus of claim 13 wherein the start wedge comprises a plurality of winding layers stacked onto one another.

17. Winding apparatus comprising:

a bobbin including at one end thereof a start wedge having a wedge angle relative to the longitudinal axis of the bobbin;

a wire-feeder device; and a spindle drive mechanically connected to the bobbin to impart rotation to the bobbin during a winding operation, wherein the spindle drive is positioned to provide relative alignment between the bobbin and the wire feeder device so that a strand of wire supplied by the feeder device is fed and continuously maintained perpendicular relative to a layer of winding that progressively propagates along the longitudinal axis of the bobbin with a predefined winding angle, the alignment thus provided enabling to reduce coil wire slippage, wherein the relative alignment between the bobbin and the wire feeder device is achieved by tilting the spindle drive by an amount corresponding to the winding angle relative to a vertically incoming strand of wire.

18. The winding apparatus of claim 17 wherein the tilting of the spindle drive is performed clockwise relative to the vertically incoming strand of wire.

19. The winding apparatus of claim 17 wherein the tilting of the spindle drive is performed counter-clockwise relative to the vertically incoming strand of wire.

20. The winding method of claim 1 wherein the providing of relative alignment between the bobbin and the wire feeder device comprises tilting the bobbin by an amount corresponding to the winding angle relative to a vertically incoming strand of wire.

21. The winding method of claim 8 wherein the providing of relative alignment between the bobbin and the wire feeder device comprises tilting the spindle drive by an amount corresponding to the winding angle relative to a vertically incoming strand of wire.

22. The winding apparatus of claim 13 wherein the relative alignment between the bobbin and the wire feeder device is achieved by tilting the spindle drive by an amount corresponding to the winding angle relative to a vertically incoming strand of wire.

* * * * *